US005759982A

United States Patent [19]

Wise et al.

[11] Patent Number: 5,759,982

[45] Date of Patent: Jun. 2, 1998

[54] LAUNDRY BARS WITH POLYETHYLENE GLYCOL AS A PROCESSING AID

[75] Inventors: Rodney Mahlon Wise, Cincinnati; Ricky Beasley, Moscow, both of Ohio

[73] Assignee: The Procter & Gamble Company, Cincinnati, Ohio

[21] Appl. No.: 881,434

[22] Filed: Jun. 24, 1997

Related U.S. Application Data

[63] Continuation of Ser. No. 443,857, Jun. 2, 1995, abandoned, which is a continuation-in-part of Ser. No. 261,570, Jun. 17, 1994, abandoned.

[51] Int. Cl.[6] ..... C11D 1/04; C11D 1/29; C11D 1/72; C11D 13/18

[52] U.S. Cl. ..... 510/352; 510/356; 510/357; 510/450; 510/451

[58] Field of Search ..... 510/352, 356, 510/357, 450, 451

[56] References Cited

U.S. PATENT DOCUMENTS

| | | | |
|---|---|---|---|
| 2,806,001 | 9/1957 | Fong et al. | 252/161 |
| 2,972,583 | 2/1961 | Hewitt | 252/161 |
| 3,434,974 | 3/1969 | Austin et al. | 252/138 |
| 3,622,517 | 11/1971 | Norton | 252/554 |
| 3,798,181 | 3/1974 | Vazquez | 252/539 |
| 4,515,707 | 5/1985 | Brooks | 252/368 |
| 4,543,204 | 9/1985 | Gervasio | 252/531 |
| 4,915,862 | 4/1990 | Beerse et al. | 252/90 |
| 4,925,585 | 5/1990 | Strauss et al. | 252/89.1 |
| 4,983,315 | 1/1991 | Glogowski et al. | 252/102 |
| 5,089,174 | 2/1992 | Kaw et al. | 252/553 |
| 5,174,927 | 12/1992 | Honsa | 252/543 |
| 5,178,798 | 1/1993 | Jolicoeur | 252/553 |
| 5,223,179 | 6/1993 | Connor et al. | 252/548 |
| 5,292,448 | 3/1994 | Klugkist | 252/174.12 |
| 5,332,528 | 7/1994 | Dan et al. | 252/548 |
| 5,338,491 | 8/1994 | Connor et al. | 252/548 |
| 5,380,447 | 1/1995 | Kirk et al. | 252/8.6 |
| 5,417,879 | 5/1995 | Hall et al. | 252/174.17 |

*Primary Examiner*—Paul Liebermann
*Assistant Examiner*—Gregory R. Delcotto
*Attorney, Agent, or Firm*—Daniel F. Nesbitt; Milton B. Graff; Donald E. Hasse

[57] ABSTRACT

The subject invention involves laundry compositions comprising:

(a) from about 10% to about 35%, anionic surfactant, (b) at least about 0.5% polyethylene glycol, (c) at least about 5% water, and (d) at least about 5% phosphate builder; the composition being in the form of a bar; and processes for making such bars.

14 Claims, No Drawings

LAUNDRY BARS WITH POLYETHYLENE GLYCOL AS A PROCESSING AID

This is a continuation of application Ser. No. 08/443,857, filed on Jun. 2, 1995, abandoned which is a continuation-in-part of Ser. No. 261,570, filed Jun. 17, 1994, abandoned.

TECHNICAL FIELD

This invention relates to laundry detergent bar compositions, and processes for making them.

BACKGROUND OF THE INVENTION

In current methods for making laundry bars, a blend of bar components is extruded into a strip which is cut to individual bar lengths, and then conveyed to cooling and wrapping steps. For these process steps to be completed without damage to the bar and with efficient operation of the processing equipment, the bar component blend should be firm and the extruded strip should be rigid. A soft non-rigid bar is difficult to form, cut, convey, and wrap without frequent bar damage and consequent production shutdowns to remove and re-work damaged bars.

High moisture laundry bar compositions may be non-rigid and difficult to process. One way to maintain bar firmness is to limit the water content of the bar component blend. The water content of surfactant pastes is one of the major sources of water in the bar blend. Therefore, pre-dried surfactant pastes are frequently used to limit bar moisture content to maintain bar firmness. However, the use of pre-dried surfactant pastes introduces an additional expensive step to the bar making process.

Therefore, there is a need for laundry compositions that can be efficiently processed in the form of higher moisture bars. Such compositions provide advantages in economy, process control, and formulation flexibility.

SUMMARY OF THE INVENTION

The subject invention involves laundry bar compositions comprising from about 10% to about 35% anionic surfactant mixture, at least about 5% water, at least about 0.5% polyethylene glycol (PEG), and at least about 5% phosphate builder; and processes for making such compositions.

DETAILED DESCRIPTION OF THE INVENTION

Some raw materials useful in making the subject invention laundry bars, such as alkyl sulfate and alkylethoxy sulfate surfactants, are most available and cheapest in the form of high-moisture aqueous pastes. Such high-moisture materials may be precluded from economic use in laundry bars because of processing difficulties and resulting high-moisture, low-rigidity bars. It has been discovered that high moisture laundry bar component blends, containing at least 5% water, can be made firm enough for effective processing by adding polyethylene-glycol (PEG). Adding PEG as a processing aid enables production of high moisture anionic surfactant-containing bars that are sufficiently rigid and firm for effective processing. Another advantage of using surfactant paste raw materials is that, in processing bar compositions using dry ingredients, temperature control can be difficult, and heated pastes can help heat such mixtures for extrusion. Therefore, the use of the paste form of surfactants can lead to improved costs, less difficult temperature control and more efficient processing.

All percentages given herein are weight percent, unless otherwise specified.

Anionic Surfactants

The subject invention involves laundry bars with compositions comprising anionic surfactants. The anionic surfactant preferably is comprised of at least 60%, more preferably at least 85%, more preferably still consists essentially of, surfactants selected from alkylbenzene sulfonates which may be branched (ABS) or linear (LAS), alkyl sulfates, alkylethoxy sulfates, and mixtures thereof. The preferred surfactants are broadly used in laundry bars. They have demonstrated desirable performance properties and are available in large quantities.

Alkylbenzene has a hydrocarbon chain substituted for one of the hydrogens in the benzene molecule. The chain length designations for alkylbenzene refer to the hydrocarbon chain substituent. Suitable alkylbenzene sulfonates include the alkali (lithium, sodium, and/or potassium), ammonium and/or alkanolammonium salts of alkylbenzene sulfonic acids. Alkylbenzene sulfonic acids useful as precursors for these surfactants are preferably straight-chain, and include decylbenzene sulfonic acid, undecylbenzene sulfonic acid, dodecylbenzene sulfonic acid, tridecylbenzene sulfonic acid, tetradecylbenzene sulfonic acid, and mixtures thereof. Typically, mixtures are used and the chain length designation, such as $C_{13}$, indicates the average alkyl chain length of the mixture; about $C_{11}$ to about $C_{14}$ are preferred. The linear alkylbenzene sulfonates (LAS) of this invention have straight (only incidental branching) chains.

The alkyl sulfates (AS) of this invention include the sodium, potassium, lithium, ammonium, and alkanolammonium salts of alkyl sulfuric acids preferably having chain lengths in the range of from about $C_{10}$ to about $C_{20}$. Alkyl sulfates having chain lengths in the about 12 to about 18 range are preferred, with chain lengths in the about 12 to about 14 range more preferred. Especially preferred are the alkyl sulfates made by sulfating primary alcohols derived from coconut oil. Coconut-derived alkyl sulfate (CFAS) is especially preferred because coconut oil is plentiful and its use has economic and regulatory significance in some areas where there is frequent use of laundry bars. Another useful source of AS is tallow.

The term "coconut oil" is used herein in connection with materials with fatty acid mixtures which typically have an approximate carbon chain length distribution of about 5–10% $C_8$, 5–10% $C_{10}$, 45–55% $C_{12}$, 15–20% $C_{14}$, 5–10% $C_{16}$, 1–3% $C_{18}$, 5–10% oleic, and 1–3% linoleic (the first six fatty acids listed being saturated). Other sources having similar carbon chain length distribution in their fatty acids, such as palm kernel oil and babasu oil, are included within the term coconut oil.

The term "tallow" is used herein in connection with materials with fatty acid mixtures which typically have an approximate carbon chain length distribution of about 2–4% $C_{14}$, 25–35% $C_{16}$, 20–25% $C_{18}$, 1–3% palmitoleic, 35–45% oleic, and 2–4% linoleic (the first three fatty acids listed are saturated). Other mixtures with similar distribution, such as those from palm oil and those derived from various animal tallows and lard, are also included within the term tallow. The tallow can be hardened, i.e., (hydrogenated) to convert part or all of the unsaturated fatty acid moieties to saturated fatty acid moieties.

Alkylalkoxy sulfates comprise an alkyl portion having from about 6 to about 22 carbon atoms, preferably from about 12 to about 18 carbon atoms, and a polyalkyloxy portion containing, on average, from about 0.5 to about 20 moles of alkoxy, preferably ethoxy, units, preferably from about 1 to about 12 ethoxy units, more preferably from about 2 to about 6 ethoxy units, more preferably still about 3 ethoxy units. Alkylethoxy sulfates (AES) are also referred to as $AE_xS$ with x being the average number of ethoxy moieties in the polyalkyloxy portion of the molecule.

Alkyl sulfates and alkylalkoxy sulfates are generally unstable in their acid forms, and therefore are not readily available as raw materials for the subject invention bars in that form. Alkyl sulfates and alkylethoxy sulfates are readily available as raw materials in the form of aqueous pastes of their sodium and potassium salts. Such aqueous pastes typically contain from about 17% to about 30% water, preferably from about 20% to about 28% water. It is preferred to avoid drying of these pastes in order to reduce the cost of making the subject invention bars; therefore it is advantageous to incorporate as high a proportion of surfactant paste as will enable meeting minimum acceptable bar rigidity. A typical anionic surfactant paste composition, such as coconut alkyl sulfate paste, is as follows:

| Component | % by Weight |
|---|---|
| CFAS | 65–75 |
| Coco Alcohol | 2–4 |
| $Na_2SO_4$ | 1–4 |
| Water | 20–30 |

Aqueous pastes of CFAS, a preferred anionic surfactant, may be made, for example, by the following process:

1. Reacting coconut-derived primary alcohol with $SO_3$ or oleum to produce alkyl sulfuric acids.
2. Neutralizing the alkyl sulfuric acid with an aqueous solution of alkali metal hydroxide, such as NaOH, to form an aqueous surfactant paste.

It is preferred, in the compositions of this invention, that the anionic surfactant mixture comprise at least about 60% AS or AES, and more preferably at least about 85% AS or AES, also preferably 100% AS or AES. AS is especially preferred.

Such anionic surfactants may be used in making bars of the subject invention either in the form of an aqueous paste, or in dry form, such as powder or extruded noodle; or portions of both forms may be used.

Additional optional anionic surfactants that can be incorporated in the subject invention compositions, preferably at levels of from 0% to about 5%, include:

Sodium alkyl glyceryl ether sulfates, especially those ethers of higher alcohols derived from tallow and coconut oil;

Sodium coconut oil fatty acid monoglyceride sulfonates and sulfates;

Sodium or potassium salts of alkyl phenol ethylene oxide ether sulfates, and sodium or potassium salts of methyl ester $R—CH(SO_3M)—COOR'$, wherein R is $C_8$–$C_{22}$ alkyl or alkenyl, R' is $C_1$–$C_4$ alkyl, and M is a counter ion, preferably Na or K;

Secondary alkyl sulfates having an alkyl chain of from 10 to 20 carbon atoms;

Alkyl ethoxy carboxylates of the formula $RO(CH_2CH_2O)_xCH_2COO^-M^+$, wherein R is a $C_6$ to $C_{18}$ alkyl; x ranges from 0 to 10, wherein the average x is 2–6 when the average R is $C_{13}$ or less, and is 3–8 when R is greater than $C_{13}$; and M is an alkali metal, alkali earth metal, ammonium, mono-, di-, and tri-ethanol ammonium.

The subject invention laundry bars comprise from about 10% to about 35% anionic surfactant, preferably from about 15% to about 32%, more preferably from about 20% to about 30%.

Polyethylene Glycol

Polyethylene glycol (PEG) has the general formula:

$$HO(C_2H_4O)_nH$$

wherein n represents the degree of polymerization, for example, for tetraethyleneglycol, n=4. Polyethylene can be characterized by degree of polymerization (n or DP) or by molecular weight (MW). The relationship between n and MW is defined by the equation: MW=44n+18.

By the nature of polymer-forming reactions, the products obtained under any one set of conditions comprise a mixture of polymers having a range of molecular weights. The range of molecular weights of the individual polymers in a polyethylene glycol product are typically clustered about an average value. This average molecular weight is used to characterize PEG products and is commonly referred to as the molecular weight of the product. As used herein in reference to PEG products, the term "molecular weight" refers to the average molecular weight of the polymeric mixture.

PEG is available in molecular weights ranging from about 200 to about 20,000. The objectives of this invention are achieved by using PEG's having molecular weights of at least about 1000 or 1100. The preferred molecular weight range is from about 1200 to about 20,000; more preferred is from about 1300 to about 15,000; more preferred still is from about 1400 to about 12,000. PEG's of molecular weights lower than about 1200 may contain undesirable amounts of lower DP polymers (200–500 molecular weight) that are lower melting and more hygroscopic than the higher-DP polymers. Therefore, PEG mixtures with no more than about 20%, preferably no more than about 10% of the mixture having molecular weights of less than about 500 are preferred for incorporation into the laundry bar compositions of this invention. In comparison with lower molecular weight PEG's, PEG's having molecular weights above about 10,000 are higher melting and their aqueous solutions have higher viscosities, and may make processing of the bars more difficult.

Processing advantages may be realized in blends containing as little as 0.5%, by weight, PEG. However, the minimum effective amount of PEG depends on the water content and the processing properties of the ingredients in the blend. To assure realization of the advantages of the process of this invention over a broad range of blend compositions, it is preferred that the process blend comprise at least 1% PEG, and more preferred that the process blend comprise at least 2% PEG.

It is preferred, for economic and formulation flexibility reasons, to limit the amount of PEG used as a processing aid. For these reasons, it is preferred to limit the PEG to an upper limit of about 10% of the bar component blend. A more upper preferred limit is about 6%, more preferred still about 5%.

Water

Water is an essential ingredient in the laundry bar compositions of the subject invention. If there is too much water in the composition, the bars may not be sufficiently firm and may not maintain their desired shape. However, if there is too little water in the composition, the bars may lack integrity and be unacceptably brittle. It has been found that the bars of this invention, comprising PEG and phosphate builder, can maintain desirable firmness at moisture concentrations above 5%. In the compositions of this invention, the moisture concentrations are preferably from about 5% to about 9%, more preferably from about 5.5% to about 8.5%, more preferably still from about 6% to about 8%.

Phosphate and Other Builders

The laundry bars of the subject invention comprise at least 5% phosphate builder. Preferred laundry bars of this invention comprise from about 5% to about 30% phosphate builder, more preferably from about 7% to about 20% phosphate builder. The phosphate builders useful in the bars of this invention are water-soluble alkali-metal salts of phosphates, pyrophosphates, orthophosphates, tripolyphosphates, higher polyphosphates, and mixtures thereof. Preferred phosphate builders include sodium tripolyphosphates (STPP) and sodium pyrophosphates (TSPP), and mixtures thereof. These preferred phosphate builders can form stable hydrates, such as STPP-hexahydrate and TSPP-decahydrate, through combination with water in the compositions of this invention.

There can be bar property advantages for compositions of this invention wherein some of the composition's water content has been combined, both during making and upon cooling, by hydration of the phosphate builder. Although the PEG component imparts firmness to a high-moisture bar during processing, it is useful to have the hydrating phosphate builders to bind water sufficient to further harden the bar for market and consumer handling. Therefore, the step of adding un-hydrated (less than about 1% moisture) phosphate builder, especially sodium pyrophosphate (TSPP) or sodium tripolyphosphate, is comprised in the preferred processes for making the compositions of this invention.

The laundry bars of the present invention comprise from about 5% to about 60% by weight detergent builder. Preferred laundry bars comprise from about 5% to about 30% builder, more preferably from about 7% to about 20%. In addition to the above phosphate builders, a portion of the builders comprised in compositions of this invention can, optionally be non-phosphate detergent builders.

Specific examples of nonphosphorous, inorganic detergency builders include water-soluble inorganic carbonate and bicarbonate salts. The alkali metal (e.g., sodium and potassium) carbonates, bicarbonates, and silicates are particularly useful herein. Sodium silicate can be used at up to about 15% silicate solids having a weight ratio of $SiO_2$ to $Na_2O$ between about 1:1 and about 3.4:1. Layered sodium silicate, most preferably commercially available as SKS-6 ($Na_2Si_2O_5$), is available from Hoechst. Also useful are aluminosilicate ion exchange materials. These aluminosilicates can be crystalline or amorphous in structure and can be either naturally occurring or synthetically derived. Preferred synthetic crystalline aluminosilicate ion exchange materials useful herein are available under the designations Zeolite A, Zeolite B, Zeolite MAP, and Zeolite X.

Water-soluble organic detergency builders, for example alkali metal, ammonium and substituted ammonium polycarboxylates, are also useful herein. Specific examples of useful polycarboxylate builder salts include sodium, potassium, ammonium and substituted ammonium salts of ethylenediaminetetraacetic acid, nitrilotriacetic acid, oxydisuccinic acid, mellitic acid, benzene polycarboxylic acid, polyacrylic acid, polymaleic acid, acrylic acid maleic acid copolymers, polyaspartic acid, and citric acid, or such acids per se. Mixtures of detergent builders, and complexes thereof and an acetate chelant, particularly one selected from the group consisting of diethylenetriamine penta(acetic acid), can be used in the present invention.

Specifically preferred examples of non-phosphate builders include zeolites and polycarboxylates.

Optional Ingredients The subject invention laundry bars comprise other optional ingredients in amounts from 0% to about 60%, preferably from about 10% to about 50%.

An optional component of the laundry bars of the present invention is a detergent chelant. Such a chelant is able to sequester earth metal cations such as magnesium and calcium, and, most importantly, heavy metal cations such as iron, manganese, zinc and aluminum.

The detergent chelant may be a phosphonate chelant, particular one selected from the group consisting of diethylenetriamine penta(methylene phosphonic acid), ethylene diamine tetra(methylene phosphonic acid), and ethylene diamine tetra(acetic acid), and mixtures and salts and complexes thereof. Preferred chelants are ethylene diamine succinate salts. The detergent chelant is included in the laundry bar at a level up to about 5%, preferably from about 0.1% to about 3%, more preferably from about 0.2% to about 2%, most preferably from about 0.5% to about 1%.

In addition to the surfactants mentioned above, a hydrotrope, or mixture of hydrotropes, may be present in the laundry detergent bar. Preferred hydrotropes include the alkali metal, preferably sodium, salts of tolune sulfonate, xylene sulfonate, cumene sulfonate, sulfosuccinate, and mixtures thereof. Preferably, the hydrotrope, in either the acid form or the salt form, and being substantially anhydrous, may be advantageously pre-mixed with any linear alkylbenzene sulfonic acid prior to its neutralization. The hydrotrope will preferably be present at from about 0.5% to about 5% of the laundry detergent bar.

Another particularly preferred component is a detergent enzyme. Particularly preferred are cellulase, lipase, protease, amylase, and mixtures thereof. Mixtures of enzymes are advantageously used at concentrations up to about 5%.

Another preferred additional component of the subject laundry bars is fatty alcohol having an alkyl chain of from about 8 to about 22 carbon atoms, more preferably from about 12 to about 18 carbon atoms. Fatty alcohol is effective at reducing the bar wear rate and smear (mushiness) of the laundry bars. A preferred fatty alcohol has an alkyl chain predominantly containing from about 16 to about 18 carbon atoms, so-called "high-cut fatty alcohol", which can exhibit less base odor of fatty alcohol relative to broad cut fatty alcohols. Typically fatty alcohol is contained in the laundry bar at up to a level of about 10%, more preferably from about 0.75% to about 6%, most preferably from about 2% to about 5%. The fatty alcohol is generally added to the formulation of the present invention as free fatty alcohol. However, low levels of fatty alcohol can be introduced into the bars as impurities or as unreacted starting material. For example, laundry bars based on coconut fatty alkyl sulfate can contain, as unreacted starting material, from about 0.1% to about 3.5%, more typically from about 2% to about 3%, by weight of free coconut fatty alcohol on a coconut fatty alkyl sulfate basis.

The free fatty alcohol may also serve as a suds booster, for reinforcing and extending suds generation and longevity. For suds boosting, a preferred fatty alcohol has an alkyl chain predominantly having from about 12 to about 14 carbon atoms, used in the composition at a level from about 0.5% to about 3%. Preferably, a narrow-cut about $C_{12}$ alkyl alcohol is used at a level of from about 0.5% to about 2%.

The laundry bar compositions of this invention may include a soil release polymer. Such soil release polymers can be used at levels up to about 5%, preferably at from about 0.05% to about 3%, more preferably from about 0.2% to about 1.0%. A soil release polymer can improve the multi-cycle cleaning of clothes washed with the laundry bar.

An example of a suitable soil release polymer is a sulfonated poly-ethoxy/propoxy end-capped ester oligomer polymer, which comprises: (i) from about 1 to about 2 moles of sulfonated poly-ethoxy/propoxy end-capped units of the formula $((MO_3S)CH_2)_m(CH_2)_m(CH_2CH_2O)(RO)_n$—, wherein M is a salt forming cation selected from the group consisting of sodium and tetraalkylammonium, m is 0 or 1, R is ethylene, propylene or a mixture thereof, and n is from 0 to 2; (ii) from about 0.5 to about 66 moles of units selected from the group consisting of: a) oxyethyleneoxy units; b) a mixture of oxyethyleneoxy and oxy-1,2-propyleneoxy units wherein said oxyethyleneoxy units are present in an oxyethyleneoxy to oxy-1,2-ally ester oligomer polymer having the formula:

$$NaO_3S(CH_2CH_2O)_2—C(O)—(C_6H_4)—C(O)O—[—CH_2CRH—O—C(O)—(C_6H_4)—C(O)O—]—[—CH_2CRH—O—O(O)—(C_6H_4)SO_3Na—C(O)O—]—CH_2CH_2OCH_2CH_2SO_3Na$$

wherein R is H or $CH_3$ in a ratio of about 1.8:1.

Either liquid or granular forms of the soil release polymer can be added to the compositions of this invention.

Other preferred optional components in the laundry bars are dye transfer inhibiting (DTI) ingredients that can reduce or prevent the detrimental effects of laundering on the color fidelity and color intensity of laundered articles. Effective DTI ingredients include materials that inhibit deposition of fugitives dyes on fabrics and materials that decolorize fugitives dyes. Examples of dye-decolorizing materials are oxidizing agents such as hydrogen peroxide or sources of hydrogen peroxide, such as percarbonate or perborate. Examples of dye-deposition inhibiting materials are polymeric materials. Especially useful are polymeric DTI materials such as polyvinylpyrridine N-oxide, polyvinylpyrrolidone (PVP), PVP-polyvinylimidazole copolymer, and mixtures thereof.

One or more of the polymeric DTI materials can also be combined with one or more of the dye-decolorizing DTI materials. The DTI material combinations may be advantageously used at levels in the bar up to about 10%, preferably from about 0.05% to about 5%, more preferably from about 0.2% to about 2%.

Another preferred optional component in the laundry bar is a fabric softener component. A preferred fabric softener component ingredient can include softening clay, such as montmorillonite, bentonite, and hectorite clay, as well as an acid-treated bentonite or other softening clay. Compositions of this invention containing a softening clay may also advantageously include a polymeric clay-flocculating agent such as polyethylene oxide having molecular weight in the range of from about 300,000 to about 5,000,000.

Yet another optional component in the laundry bar is a bleach component. The bleaching component can be a source of $^{-}OOH$ group, such as sodium perborate monohydrate, sodium perborate tetrahydrate and sodium percarbonate. Sodium percarbonate ($2Na_2CO_3 \cdot 3H_2O_2$) is preferred since it has a dual function of both a source of HOOH and a source of sodium carbonate.

Peroxygen bleaching agents are preferably combined with bleach activators, which lead to the in situ production in aqueous solution (i.e., during the washing process) of the peroxy acid corresponding to the bleach activator.

Preferred bleach activators incorporated into compositions of the present invention have the general formula:

$$R—\overset{\overset{\displaystyle O}{\|}}{C}—L$$

wherein R is an alkyl group containing from about 1 to about 18 carbon atoms wherein the longest linear alkyl chain extending from and including the carbonyl carbon contains from about 6 to about 10 carbons atoms and L is a leaving group, the conjugate acid of which has a $pK_a$ in the range of from about 4 to about 13. An example of such a preferred bleach activator is nonanoyl oxybenzene sulfonate (NOBS).

Another optional bleaching component is a peracid per se, such as a formula:

$$CH_3(CH_2)_w—NH—C(O)—(CH_2)_zCO_3H$$

wherein z is from 2 to 4 and w is from 4 to 10. (The compound of the latter formula where z is 4 and w is 8 is hereinafter referred to as NAPAA.) The bleaching component can contain, as a bleaching component stabilizer, a chelating agent of polyaminocarboxylic acids, polyaminocarboxylates such as ethylenediaminotetraacetic acid, diethylenetriaminopentaacetic acid, and ethylenediaminodisuccinic acid, and their salts with water-soluble alkali metals. The bleach components can be added to the bar at a level up to about 20%, preferably from about 1% to about 10%, more preferably from about 2% to about 6%.

Sodium sulfate is a well-known filler that is compatible with the compositions of this invention. It can be a by-product of the surfactant sulfation and sulfonation processes, or it can be added separately. Sodium sulfate can be present at levels of from 0% to about 30%, preferably at levels of from about 2% to about 10%.

Calcium carbonate (also known as Calcarb) is also a well known and often used component of laundry bars. Such materials are typically used at levels up to about 40%, preferably from about 5% to about 25%.

Binding agents for holding the bar together in a cohesive, soluble form can also be used, and include natural and synthetic starches, gums, thickeners, and mixtures thereof. Some binding agents can also serve as soil suspending agents, and can include materials such as water-soluble salts of carboxymethylcellulose (CMC) and carboxyhydroxymethylcellulose.

A preferred soil suspending agent which can optionally be used is an acrylic/maleic copolymer, commercially available as Sokalan CP®, from BASF Corp. Other soil suspending agents include ethoxylated mono- and polyamines, and quaternary salts thereof.

Dyes, pigments, optical brighteners, germicides, and perfumes can also be added to the subject bar compositions.

Laundry Bar Processing

The laundry bar compositions of the subject invention can be made using conventional soap or detergent bar making equipment with some or all of the following key equipment: blender/mixer, mill or refining plodder, two-stage vacuum plodder, logo printer/cutter, cooling tunnel and wrapper.

In a typical process, the components of the bar composition, including anionic surfactant, are mixed in the blender. The mixing may take from 1 minute to 1 hour, with a typical mixing time being from about 2 to about 20 minutes. The blender mix is discharged to a surge tank. The product is then optionally conveyed from the surge tank to the mill or refining plodder via a multi-worm transfer conveyor.

After the optional milling or preliminary plodding, the product is then conveyed to a double stage vacuum plodder, operating at a high vacuum, e.g. about 600 to about 740 millimeters of mercury vacuum, so that entrapped air and carbon dioxide are removed. The product is extruded and cut to the desired bar length, and optionally printed with the product brand name. The finished bar can be cooled, for example in a cooling tunnel, before it is wrapped, cased, and sent to storage.

In making bar compositions of the present invention, the water content of the component blend can be increased by adding some of the anionic surfactant in the form of an aqueous paste. In the subject invention processes, the percentage of water in the final bar, which enters the process in the paste of anionic surfactant, is preferably at least about 50%, more preferably at least about 80%.

The portion of the anionic surfactant added as aqueous paste is preferably at least about 30%, more preferably at least about 50%, more preferably still at least about 80%. Aqueous pastes of AS and AES surfactants are preferred, especially AS. LAS, ABS, and other surfactants which are stable in their acid form are preferably added to the process in substantially anhydrous, molton acid form, which is neutralized, preferably in the subject process, by a solid basic material such as a carbonate.

In making bar compositions of the present invention, PEG is added to the blend as a processing aid. The PEG maintains blend firmness at the high water content achieved by adding aqueous anionic surfactant paste to the blend. A preferred method of adding PEG is to make a pre-addition mixture with the surfactant paste, for example, by adding PEG during the surfactant neutralization step. Another preferred method of adding PEG is to predissolve the PEG in water at a ratio of PEG to water of about 1:1, the temperature of the water being above the melting point of the PEG.

TEST METHODS

Penetration Test: Bar Firmness

A measure of the bar firmness (hardness) is obtained, for fresh bars and aged bars, by the depth penetrated by the penetrometer needle.

Apparatus:

Penetrometer: Dow Penetrometer or Precision Universal Penetrometer

Needle, shaft, collar: Wt. 47 gram. Additional 100 g and 50 g weights to put on top of the needle shaft. Use 50 grams for fresh bars and the total 150 grams of additional weight on the needle shaft for the aged bars.

Precautions:

1. Always protect the penetrometer needle with a rubber stopper when not being used. Never let it impact a metal surface.
2. If the needle point and cone become blunt or dented, have it re-machined.

Sample Preparation and Procedure:

Fresh Bar: Take a freshly extruded bar and cut it in half. Put one half on the penetrometer keeping it as flat as possible and measure the penetration. Measure the temperature of the bar on the other half. All measurements are to be completed within one (1) minute of the bar being extruded.

Aged Bar: Bars must be at least 1 to 2 days old before testing, and be protected while aging to prevent drying. Wrap bars in polyethylene and equilibrate the wrapped bars at ambient temperature for at least one day before testing. Determine the penetration at ambient room temperature.

Penetrometer Method:

1. Place the required additional weight on the penetration cone (needle) shaft.
2. Squeeze the cone release on front of the penetrometer and raise it to its uppermost position. Also raise the depth gauge rod to its uppermost position. The scale indicator should read zero.
3. Now, while holding the cone, slowly lower it by pressing the finger release, until there is a slight deflection on the indicators reading. Release the finger release thus locking the cone in its position. This is the zero depth for the penetrometer.
4. Place bar on a smooth flat surface (i.e., flat metal plate) for stability.
5. Lower the penetrometer frame until the penetration cone (needle) is just in contact with the surface of the bar.
6. Now raise the cone to the uppermost position by pressing the finger release. Release the finger release and secure the cone in the uppermost position.
7. Lower depth gauge rod (push on top of it) for a minimum of at least one half turn on the indicator scale.
8. Now press the finger release switch and allow penetration cone to fall into the bar.
9. Raise the depth gauge rod until it stops. The scale reading is the depth penetrated by the penetrometer needle in 0.1 mm units.
10. Read penetrations on the flat area next to the logo. Take at least two readings. If they disagree by more than two units, take additional readings; report the average of first two readings which agree within two units.

The penetration firmness test results for laundry bars of the subject invention which are freshly made are preferably about 90 units (9.0 mm) or less, more preferably about 80 units or less, more preferably still from about 50 units to about 75 units. After the bars age for at least 24 hours, the penetration tests results are lower: preferably less than about 75 units, more preferably less than about 70 units, more preferably still from about 40 units to about 68 units, still more preferably from about 50 units to about 65 units.

Fresh Bar Rigidity (Droop) Test Method

Apparatus:

Protractor—90 degrees quadrant, graduated to 5 degrees or finer

Thermometer—Graduated to 1° C. or finer

Procedure

1. Within one minute of extrusion, place a freshly extruded bar of one foot length or greater, broadside clown, on a flat surface (table top).
2. Position the bar so that it extends 133 mm over the edge of the flat surface, while maintaining support for the extended length.
3. Remove support from the extended length so that bar is free to droop.
4. Ten seconds after the bar extension support is removed, the angle of droop is measured using the protractor. The measurement (in degrees) of the angle made by the bottom edge of the drooping bar extension and the vertical is recorded as the droop.

5. Measure and record the temperature of the bar.

The rigidity (droop) test results for laundry bars of the subject invention according to the above test are preferably about 60° or less, more preferably about 45° or less, more preferably still about 30° or less.

The rigidity (droop) test results for laundry bars of the subject invention according to the above test are preferably about 60 degrees or less, more preferably about 45 degrees or less, more preferably still about 30 degrees or less.

EXAMPLES

Example 1

Synthetic detergent laundry bars are made as described above. The blending step comprises making a dry mixture of the sodium coconut fatty alkyl sulfate (CFAS, as dried noodle or flake), sodium carbonate, anhydrous sodium tripolyphosphate (STPP), anhydrous tetrasodium pyrophosphate (TSPP), and calcium carbonate. The paste form of CFAS (at 60°–70° C.) is then added while mixing and is mixed until a coarse granular texture is achieved. The CFAS raw materials, noodles or flakes or paste, comprise CFAS, water and small amounts of sodium sulfate and unreacted coconut fatty alcohol (CFA) from the alcohol sulfation and neutralization processes used to product the raw materials. Additional water is added along with any colorants or polyethylene glycol having an average molecular weight of about 8000 (PEG-8000), if added. The PEG is dissolved in approximately half its weight or greater of water, with the mixture held around 70° C. to melt the PEG and maximize solubility. Dry minors are then added —Zeolite A, sodium sulfate, brighteners, dry colorants, Sokalan CP polymer— and mixed until the mix changes from a dough to a coarse granular mix. The additional molten coconut fatty alcohol (CFA) needed to reach the target amount is added, and perfume is added last. A mixer jacket is often used with approximately 70° C. water, and the mix is roughly 50° C. when unloaded from the mixer.

The moist granular mix is unloaded with little further mixing and is transferred (with 5–10 minutes delay) to the feed hopper for the two-stage vacuum plodder. Jacketing of the plodder can be adjusted to give a range of bar temperatures at the exit die, ideally about 52°–65° C. The ability of the hot water jacketing to heat the mix in the mixer and/or plodder is often limited, so the heat contributed by preheated feedstocks such as surfactant paste is often very important for achieving minimum temperatures for plodding.

The following nominal detergent bar composition is produced:

| Ingredient | Weight % |
|---|---|
| CFAS | 30.0 |
| STPP | 5.0 |
| TSPP | 5.0 |
| Sodium Carbonate | 20.0 |
| Sodium Sulfate | 5.0 |
| Calcium Carbonate | 16.5 to 21.5 |
| Zeolite | 2.0 |
| PEG-8000 | 0 to 5 |
| Water | 7.0 |
| Sokalan Polymer | 0.4 |
| CFA (total) | 2.5 |

-continued

| Ingredient | Weight % |
|---|---|
| Minors (perfumes, brightener, and colorants) | 1.6 |

Three variants are produced, with the following component parts per hundred added in order shown:

| | Composition A | Composition B | Composition C |
|---|---|---|---|
| Ingredient | | | |
| Sodium Carbonate | 20.00 | 20.00 | 20.00 |
| CFAS Dried Noodles | 17.74 | 17.74 | 16.13 |
| STPP | 5.00 | 5.00 | 5.00 |
| TSPP | 5.00 | 5.00 | 5.00 |
| Calcium Carbonate | 21.47 | 16.47 | 16.47 |
| CFAS Paste | 18.72 | 18.88 | 20.98 |
| Water | 2.05 | 2.37 | 1.86 |
| PEG-8000 (in water above) | 0.00 | 5.00 | 5.00 |
| Dry Minors (sodium sulfate, zeolite, Sokalan, brightener, color) | 8.91 | 8.68 | 8.68 |
| CFA | 1.48 | 1.23 | 1.25 |
| Perfume | 0.43 | 0.43 | 0.43 |
| Total | 100.80 | 100.80 | 100.80 |
| Process Water Loss | −0.80 | −0.80 | −0.80 |
| Net Total | 100.00 | 100.00 | 100.00 |
| Processing Characteristic: | | | |
| Bar temperature at the die | 54° C. | 54° C. | 54° C. |
| Fresh Penetration Test (0.1 mm) | 121 | 70 | 55 |
| Fresh Droop Test (degrees) | 72 | 6 | 7 |

Processing characteristics are read as soon as the extruded bar exits from the die and is cut. It is observed that the fresh bar properties are greatly improved by the addition of PEG in the Compositions B and C. Fresh Penetrations are considered marginal in the range of 80–90. Fresh Droop is desired to be less than 60 degrees for proper handling of the hot bar, and preferably less than 30 degrees. The Composition A without PEG is thus not processable at these conditions when the surfactant paste is incorporated for preferred cost control and heat input. PEG addition greatly aids fresh bar handling. The Composition C with even more paste (total water still balanced to 7%) still has good handling, or perhaps even somewhat better.

Example 2

Further laundry bar compositions are produced by a process similar to that in Example 1, with the addition of a minor level of linear alkylbenzene sulfonate ($C_{11.8}$LAS) surfactant. The mixer is charged with sodium carbonate, STPP, and CFAS noodles, and the acid form of the LAS (HLAS) is added. The water with dissolved colorants and PEG, if added, is added, and neutralization of the HLAS by the carbonate proceeds. Wet and dry ingredients are alternately added to maintain a wet granular texture or a crumbly dough. Molten CFA, bentonite clay and calcium carbonate, and then the heated CFAS paste are added. Phosphonate chelant solution is introduced. Dry minors as defined in the previous example (plus CMC and polymeric clay-flocculating agent) are added. Finally, glycerin and perfume are added and the mix is further processed as before.

Using the above process, the following detergent bar composition is produced:

| Ingredient | Weight % |
|---|---|
| CFAS | 19.1 |
| LAS | 3.4 |
| STPP | 15.0 |
| Sodium Carbonate | 6.0 |
| Sodium Bicarbonate (from neutralization) | 0.2 |
| Sodium Sulfate | 0.4 |
| Bentonite Clay | 10.0 |
| Calcium Carbonate | 29.7 to 30.7 |
| Zeolite | 2.0 |
| PEG-8000 | 0 to 1.0 |
| Water | 6.5 |
| Phosphonate Chelant | 0.7 |
| Sokalan Polymer | 0.8 |
| Carboxymethyl Cellulose (CMC) | 0.5 |
| CFA (total) | 2.0 |
| Glycerin | 0.8 |
| Minors (perfume, colorants, brightener, polymeric clay-flocculating agent) | 2.0 |

Five variants are produced, with the following component parts per hundred added in order shown:

| | Compositions | | | | |
|---|---|---|---|---|---|
| Ingredient | D | E | F | G | H |
| Sodium Carbonate | 6.66 | 6.66 | 6.66 | 6.66 | 6.66 |
| STPP | 15.00 | 15.00 | 15.00 | 15.00 | 15.00 |
| CFAS Dried Noodles | 10.28 | 10.28 | 10.28 | 10.28 | 10.28 |
| HLAS | 3.29 | 3.29 | 3.29 | 3.29 | 3.29 |
| Water | 1.07 | 1.07 | 1.07 | 0.90 | 0.90 |
| PEG-8000 (in water above) | 0.00 | 1.00 | 0.00 | 0.00 | 0.00 |
| PEG-1450 (in water above) | 0.00 | 0.00 | 1.00 | 0.00 | 0.00 |
| PEG-1000 (in water above) | 0.00 | 0.00 | 0.00 | 1.00 | 0.00 |
| PEG-400 (in water above) | 0.00 | 0.00 | 0.00 | 0.00 | 1.00 |
| CFA | 1.35 | 1.35 | 1.35 | 1.35 | 1.35 |
| Bentonite Clay | 10.00 | 10.00 | 10.00 | 10.00 | 10.00 |
| Calcium Carbonate | 30.66 | 29.66 | 29.66 | 29.81 | 29.81 |
| CFAS Paste | 13.37 | 13.37 | 13.37 | 13.26 | 13.26 |
| Phosphonate Chelant (25%) | 2.80 | 2.80 | 2.80 | 2.80 | 2.80 |
| Dry Minors (as above) | 5.40 | 5.40 | 5.40 | 5.40 | 5.54 |
| Glycerin | 0.75 | 0.75 | 0.75 | 0.75 | 0.75 |
| Perfume | 0.35 | 0.35 | 0.35 | 0.35 | 0.35 |
| Total | 100.98 | 100.98 | 100.98 | 100.98 | 100.98 |
| Process water loss | −0.80 | −0.80 | −0.80 | −0.80 | −0.80 |
| $CO_2$ loss by vacuum | −0.18 | −0.18 | −0.18 | −0.18 | −0.18 |
| Net Total | 100.00 | 100.00 | 100.00 | 100.00 | 100.00 |
| Processing Characteristic: | | | | | |
| Bar temperature at the die | 56° C. | 56° C. | 56° C. | 55° C. | 52° C. |
| Fresh Penetration Test (0.1 mm) | 98 | 78 | 75 | 95 | 122 |
| Fresh Droop Test (degrees) | 65 | 20 | 27 | 70 | 90 |

Processing characteristics are read as soon as the extruded bar exits from the die and is cut. It is observed that the fresh bar properties are greatly improved by the addition of PEG in the Compositions E and F. Fresh Penetrations are considered marginal in the range of 80–90. Fresh Droop is desired to be less than 60 degrees for proper handling of the hot bar, and preferably less than 30 degrees. The Composition D without PEG is thus not processable at these conditions when the surfactant paste is incorporated for preferred cost control and heat input. PEGs of molecular weight of 1450 and 8000 are seen to greatly aid fresh bar handling. The Composition G with PEG 1000 is not substantially different from the control Composition D. The Composition H with the very fluid PEG 400 is actually worse regarding processing characteristics than the control.

Example 3

Laundry bar compositions are made as in Example 1, except for the use of CFAS totally in paste form and the substitution of CMC for Sokalan polymer. Further, the PEG is added as a molten liquid at about 75° C., since no free water is incorporated in the mix.

The following nominal detergent bar composition is produced:

| Ingredient | Weight % |
|---|---|
| CFAS | 26.0 |
| STPP | 5.0 |
| TSPP | 5.0 |
| Sodium Carbonate | 15.0 |
| Sodium Sulfate | 5.0 |
| Calcium Carbonate | 26.1 |
| Zeolite | 1.0 |
| PEG-3350 | 4.0 |
| Water | 8.5 |
| CMC | 1.0 |
| CFA (total) | 1.9 |
| Minors (perfumes, brightener, and colorants) | 1.5 |

The composition is produced, with the following component parts per hundred added in the order shown:

| Ingredient | Weight % of Stock Added |
|---|---|
| Sodium Carbonate | 15.00 |
| STPP | 5.00 |
| TSPP | 5.00 |
| Calcium Carbonate | 26.06 |
| CFAS Paste | 36.36 |
| PEG-3350 (molten) | 4.00 |
| Dry Minors (sodium sulfate, zeolite, CMC, brightener, colorant) | 8.08 |
| CFA | 1.00 |
| Perfume | 0.30 |
| Total | 100.80 |
| Process Water Loss | 0.80 |
| Net total | 100.00 |

While particular embodiments of the subject invention have been described, it would be obvious to those skilled in the art that various changes and modifications to the subject invention can be made without departing from the spirit and scope of the invention. It is intended to cover, in the appended claims, all such modifications that are within the scope of this invention.

What is claimed is:

1. A laundry bar making process comprising the following steps:

(a) feeding materials to a mixer, the materials comprising:

(i) from about 15% to about 35% anionic surfactant, (ii) from about 0.5% to about 10% polyethylene glycol having a molecular weight of from about 1200 to about 20,000.

(iii) from about 5% to about 9% water, and (iv) from about 5% to about 30% phosphate builder;

wherein at least about 30% of the anionic surfactant is added in the form of an aqueous paste comprising surfactants selected from the group consisting of alkyl sulfate, alkylethoxy sulfate, and mixtures thereof, and from about 17% to about 30% water;

(b) blending the materials in the mixer to form a mix;

(c) extruding the mix to form an extruded mix; and (d) cutting the extruded mix to form the bars.

2. The process of claim 1 wherein the percentage of water in the final bar, which enters the process in the aqueous paste, is at least about 50%.

3. The process of claim 2 wherein the mix comprises from about 1% to about 10% polyethylene glycol having an average molecular weight of from about 1300 to about 12,000.

4. The process of claim 3 wherein at least about 50% of the anionic surfactant enters the process in the form of the aqueous surfactant paste.

5. The process of claim 3 wherein at least about 80% of the anionic surfactant enters the process in the form of the aqueous paste, the surfactant of the aqueous paste consisting of alkyl sulfate.

6. The process of claim 4 wherein the percentage of water in the final bar, which enters the process in the aqueous paste, is at least about 80%.

7. The process of claim 3 wherein the polyethylene glycol, in molten form, is preblended with the anionic surfactant paste.

8. The process of claim 6 wherein the polyethylene glycol, in molten form, is preblended with the anionic surfactant paste.

9. The process of claim 3 wherein the polyethylene glycol is dissolved in water, prior to step (a), at a polyethylene glycol to water ratio of about 1:1, the water being at a temperature above the melting point of the polyethylene glycol.

10. The process of claim 6 wherein the polyethylene glycol is dissolved in water, prior to step (a), at a polyethylene glycol to water ratio of about 1:1, the water being at a temperature above the melting point of the polyethylene glycol.

11. The process of claim 3 wherein the phosphate builder incorporated in the mix comprises less than about 1% moisture.

12. The process of claim 3, 4, 7 or 9 wherein the aqueous surfactant paste comprises from about 20% to about 30% water.

13. The process of claim 1, 3, 4, 5, 7 or 9 wherein the mix comprises from about 20% to about 35% anionic surfactant, and from about 6% to about 9% water.

14. The process of claim 1, 3, 4, 5, 7 or 9 wherein the mix comprises from about 2% to about 6% polyethylene glycol having an average molecular weight of from about 1400 to about 10,000.

* * * * *